US005470682A

United States Patent [19]

Ashiya et al.

[11] Patent Number: 5,470,682

[45] Date of Patent: Nov. 28, 1995

[54] ELECTROPHOTOGRAPHIC PHOTORECEPTOR CONTAINING GRANULAR TRIGONAL SELENIUM

[75] Inventors: Seiji Ashiya; Takahiro Suzuki; Masanori Murase, all of Minami-ashigara, Japan

[73] Assignee: Fuji Xerox Co., Ltd., Tokyo, Japan

[21] Appl. No.: 10,858

[22] Filed: Jan. 29, 1993

[30] Foreign Application Priority Data

Feb. 5, 1992 [JP] Japan ..... 4-047756

[51] Int. Cl.[6] ..... G03G 5/082

[52] U.S. Cl. ..... 430/84; 430/128

[58] Field of Search ..... 430/84, 128

[56] References Cited

U.S. PATENT DOCUMENTS 2,739,079 3/1956 Keck ..... 430/84
3,911,091 10/1975 Karam et al. ..... 430/84
4,175,959 11/1979 Karam et al. ..... 430/134
4,548,800 10/1985 Badesha et al. ..... 423/510

FOREIGN PATENT DOCUMENTS 54-54038 4/1979 Japan .
1-124862 5/1989 Japan .

*Primary Examiner*—John Goodrow
*Attorney, Agent, or Firm*—Oliff & Berridge

[57] ABSTRACT

An electrophotographic photoreceptor comprising a photosensitive layer containing granular trigonal selenium which has a mean particle diameter of not more than 5 μm and which has absorption peaks in the X-ray diffraction spectrum using CuKα characteristic X-rays at Bragg angles (2°θ±0.2°) of 23.5°, 29.7°, 41.4°, and 45.4°, is disclosed, which has high photosensitivity and low residual potential, maintains its potential characteristics in a stable manner on repeated use, and exhibits sufficient photosensitivity even when applied to high-speed copying.

4 Claims, 2 Drawing Sheets

ELECTROPHOTOGRAPHIC PHOTORECEPTOR CONTAINING GRANULAR TRIGONAL SELENIUM

FIELD OF THE INVENTION

This invention relates to an electrophotographic photoreceptor. More particularly, it relates to an electrophotographic photoreceptor with high photosensitivity.

BACKGROUND OF THE INVENTION

Electrophotographic copying machines have been making steady advances year by year in copying speed and those which can copy papers of various sizes have been developed. Accordingly, a high-performance electrophotographic photoreceptor which can cope with this has been demanded.

In recent years, with respect to electrophotographic photoreceptors of separate function type in which a plurality of elements individually perform the required functions, various proposals have been made in order to improve the electrophotographic characteristics such as charge retention, stability on repeated use, optical response, spectral characteristics, and mechanical strength.

Various charge generating materials have hitherto been used in the photosensitive layer of an electrophotographic photoreceptor. They include inorganic photoconductive substances such as selenium, zinc oxide, and cadmium sulfide on one hand, and organic photoconductive substances such as organic pigments on the other hand. In particular, the latter are widely used because of the productivity, low cost, and safety while organic electrophotographic photoreceptors in which an organic pigment is used are not always satisfactory in terms of sensitivity, spectral characteristics, and stability on repeated use. In this respect, selenium is especially excellent in terms of sensitivity. In particular, trigonal selenium is excellent in terms of various performance properties required for a charge generating material. That is, trigonal selenium has such advantages that it has strong light absorption over a broad wavelength region to generate a carrier at a high efficiency, it exhibits high chemical stability, and it hardly undergoes deterioration on exposure to heat or light.

Electrophotographic photoreceptors using such trigonal selenium are already known and are disclosed in JP-A-54-54038 (the term "JP-A" as used herein means an "unexamined published Japanese patent application"), for example. Also, in JP-A-1-124862 is disclosed an electrophotographic photoreceptor having a photosensitive layer made by dispersing trigonal selenium in the binder resin.

The photosensitive layer of an electrophotographic photoreceptor is required to have the following performance properties. That is, performance properties such as (1) high photosensitivity, (2) low residual potential, and (3) little variation (stability) of photosensitivity, residual potential, and charging potential on repeated use, are required as particularly important. With the photosensitive layer in which trigonal selenium is used as a charge generating material, the characteristics of trigonal selenium play a predominant factor on the above-mentioned requirements (1) to (3). Electrophotographic photoreceptors in which trigonal selenium is used that have been so far proposed, however, do not satisfy all of the requirements (1) to (3), still needing improvements. As an improving means, it has been proposed for example to increase the carrier generation efficiency by giving trigonal selenium a specific crystal structure, and several crystal forms of trigonal selenium having high photosensitivity have been found. Nevertheless, it is the present situation that the technical complicatedness of the conditions for preparing such trigonal selenium and the conditions for preparing the photoreceptor has hindered the development of an electrophotographic photoreceptor which satisfies all the requirements including chargeability, photosensitivity, and stability on repeated use.

The present invention has been made based on the present state of art which has been described above.

SUMMARY OF THE INVENTION

An object of the present invention is to provide an electrophotographic photoreceptor which has high photosensitivity, low residual potential, and stable potential characteristics on repeated use.

Another object of the present invention is to provide an electrophotographic photoreceptor which has sufficient photosensitivity even when applied to high-speed copying.

The foregoing objects of the present invention can be achieved by using granular trigonal selenium which has a specific particle diameter and a specific X-ray diffraction spectrum.

That is, the electrophotographic photoreceptor of the present invention comprises a photosensitive layer containing granular trigonal selenium which has a mean particle diameter of not more than 5 μm and which has absorption peaks in the X-ray diffraction spectrum using CuKα characteristic X-rays at Bragg angles (2°θ±0.2° ) of 23.5°, 29.7°, 41.4°, and 45.4°.

In the present invention, granular trigonal selenium having main absorption peaks at Bragg angles (2°θ±0.2°) of 23.5° and 29.7° and having the strongest absorption intensity at 29.7° is particularly preferable.

DETAILED DESCRIPTION OF THE INVENTION

Figure 1:
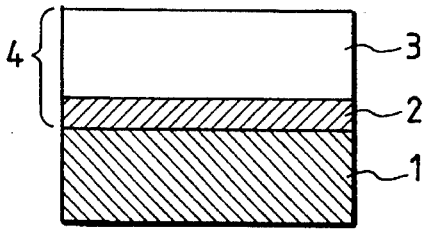
FIGS. 1 through 6 are each a schematic cross section of an electrophotographic photoreceptor according to the present invention.
Figure 2:
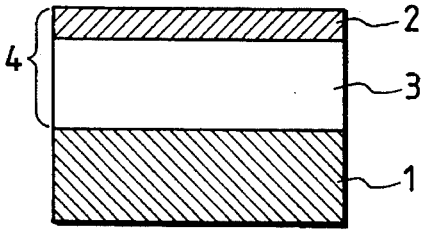
Figure 3:
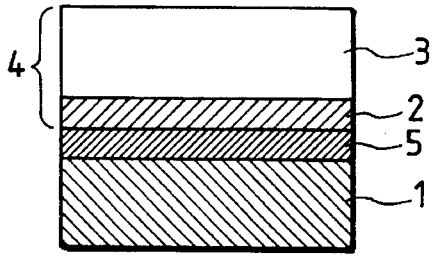
Figure 4:
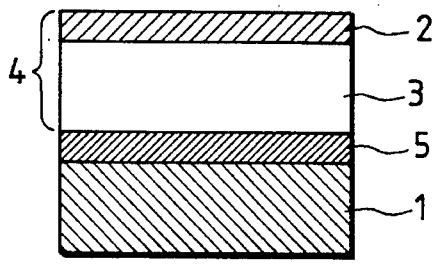
Figure 5:
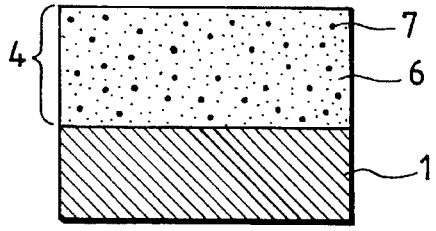
Figure 6:
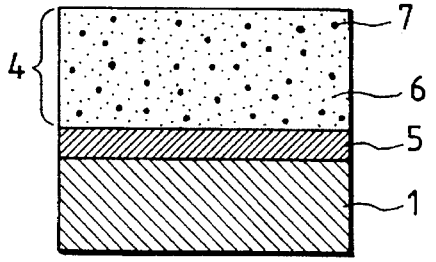

The electrophotographic photoreceptor of the present invention comprises a photosensitive layer on the conductive support. Various forms of photosensitive layer can be adopted, but the photosensitive layer generally has a layer structure illustrated in FIGS. 1 through 6. In particular, a separation function type photosensitive layer having a laminate structure or a dispersion structure is preferred. The structure of FIG. 1 comprises conductive substrate 1 having formed thereon charge generating layer 2 and charge transporting layer 3 successively to provide photosensitive layer 4. FIG. 2 illustrates a photosensitive layer 4 in which the order of charge generating layer 2 and charge transporting layer 3 is reversed. FIGS. 3 and 4 illustrate layer structures comprising intermediate layer 5 laid between photosensitive layer 4 and conductive substrate 1 of FIGS. 1 and 2, respectively. FIG. 5 illustration rates photosensitive layer 4 comprising charge generating material 6 and charge transporting material 7, and FIG. 6 illustrates a structure comprising intermediate layer 5 between photosensitive layer 4 and conductive support 1 of FIG. 5.

The electrophotographic photoreceptor according to the present invention comprises a photosensitive layer containing granular trigonal selenium as charge generating material. The granular trigonal selenium used in the present invention is produced by reductive deposition by hydrogen peroxide and is required to have a mean particle diameter of not more than 5 m and to have absorption peaks in the X-ray diffraction spectrum using CuK characteristic X-rays at Bragg angles (2°θ±0.2°) of 23.5°, 29.7°, 41.4°, and 45.4°. The lower limit of the mean particle diameter of the granular trigonal selenium is 0.01 μm. The mean particle diameter of the granular trigonal selenium is preferably from 0.1 to 1 μm. When the mean particle diameter of granular trigonal selenium is over 5 μm, the dispersion stability of trigonal selenium is deteriorated in the coating composition in which granular trigonal selenium is dispersed, which disturbs uniform formation of the photosensitive layer on coating. In addition, when trigonal selenium is in coarse particles having the mean particle diameter of over 5 μm, it causes deterioration of performance properties of the electrophotographic photoreceptor, that is, deterioration of performance such as decrease in charging potential and increase in dark decay.

In order to obtain fine particles having a mean particle diameter of not more than 5 μm in reductive deposition of granular trigonal selenium by reductive method of using aqueous hydrogen peroxide, the concentration and the amount of aqueous hydrogen peroxide to be added, the addition rate of aqueous hydrogen peroxide (that is, reduction rate), and the solution temperature at the time of addition of aqueous hydrogen peroxide are crucial parameters. Proper combination thereof enables production of fine particles and control of the particle diameter.

The molar ratio of $Se/H_2O_2$ upon reduction is preferably in the range of 1.5 to 2.0. When the molar ratio is less than 1.5, trigonal selenium produced tends to be in coarse particles while selenium is excessively oxidized, decreasing the yield when it is more than 2.0.

The solution temperature on reduction is preferably in the range of 35° to 60° C. When the solution temperature on reduction is below the range, single crystals are developed large due to the mild reduction, which leads to a larger particle diameter and leads to increase the dark decay while increasing the photosensitivity. When the solution temperature on reduction is above the range, the particle diameter of selenium becomes too small, which leads to decrease the photosensitivity.

In the photosensitive layer of the electrophotographic photoreceptor according to the present invention, other charge generating materials may be used in combination with the above-described granular trigonal selenium. As such charge generating materials can be mentioned phthalocyanine pigments including titanyl phthalocyanine, azo pigments, anthraquinone pigments, perylene pigments, polycyclic quinone pigments, and squarylium pigments, for example.

As charge transporting materials to be used in the electrophotographic photoreceptor according to the present invention can be used various kinds of known charge transporting materials. Typical examples include, for example, compounds having a nitrogen-containing heterocyclic ring or a condensed ring thereof such as an oxazole ring, an oxadiazole ring, a thiazole ring, a thiadiazole ring, or an imidazole ring; polyarylalkane compounds, pyrazoline compounds, hydrazone compounds, triarylamine compounds, styryl compounds, styryltriphenylamine compounds, β-phenylstyryltriphenylamine compounds, butadiene compounds, hexatriene compounds, carbazole compounds and condensed polycyclic compounds. Specific examples of these charge transporting materials are described for example in JP-A-53-27033. Formula of particularly typical compounds are shown below.

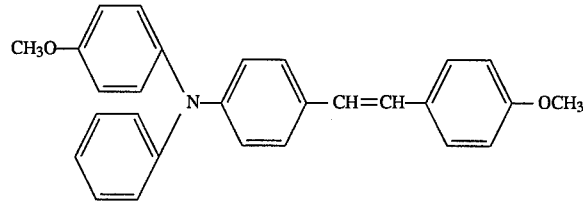

(1)

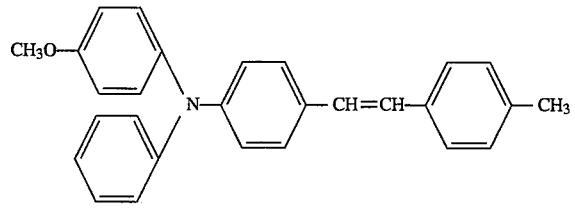

(2)

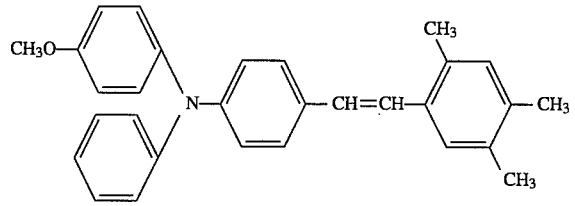

(3)

-continued
(4)
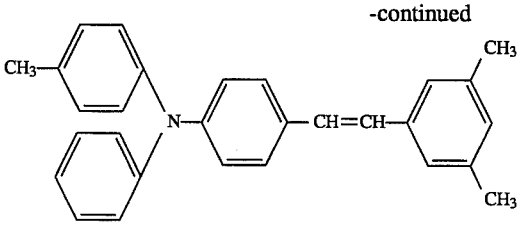
(5)
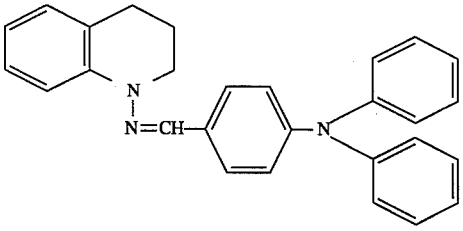
(6)
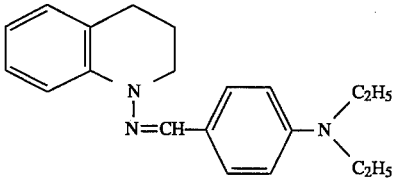
(7)
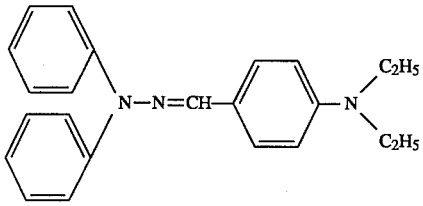
(8)
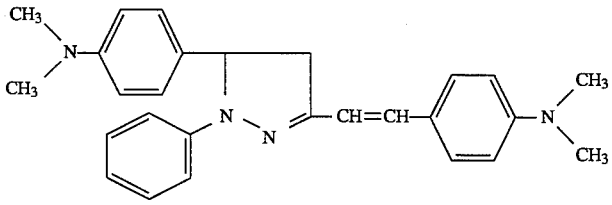
(9)
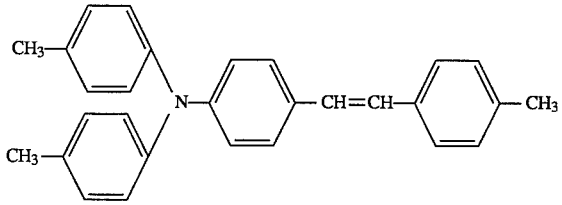
(10)
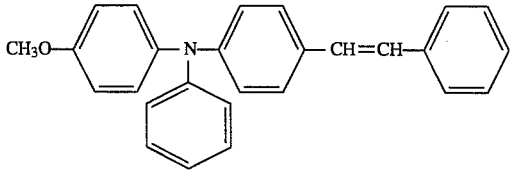

-continued
(11)
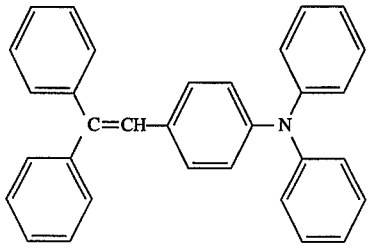
(12)
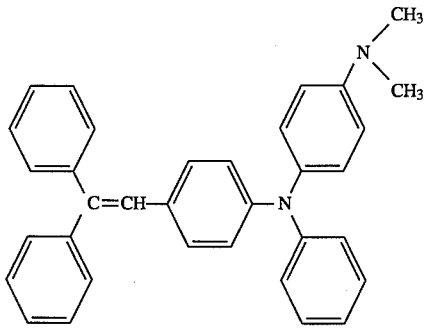
(13)
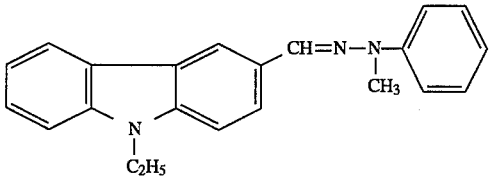
(14)
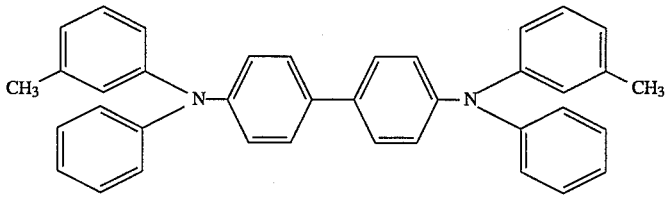
(15)
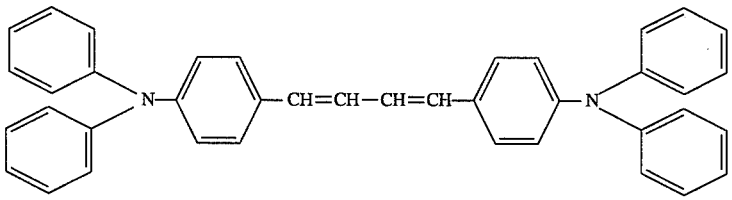
(16)
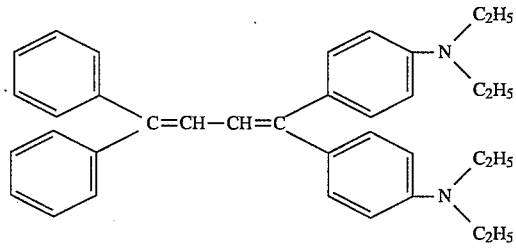
(17)
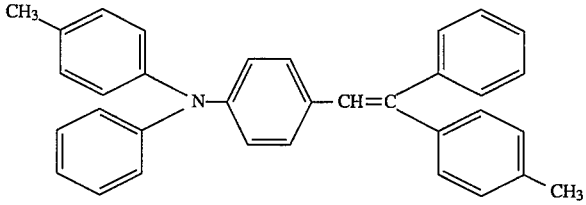

-continued (18)

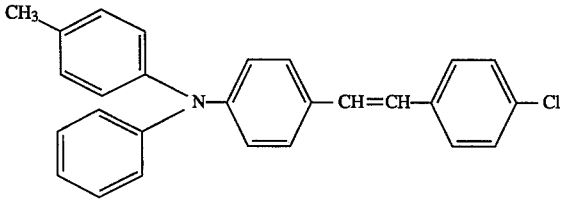

(19)

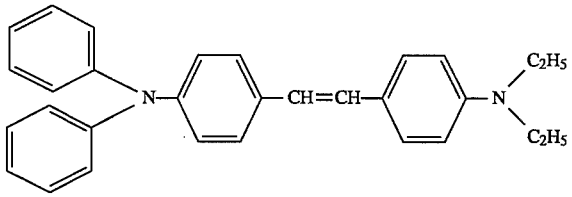

According to the present invention, the photosensitive layer can be effectively formed by coating a coating composition in which a charge-generating material or a charge transporting material is either dissolved in a solvent or dispersed in a dispersion medium alone or together with a binder resin or additives. Incidentally, since the charge generating material used in combination with trigonal selenium generally has low solubility, when a charge generating material is used in combination, it is an effective procedure that the charge transporting material is finely dispersed in an appropriate dispersion medium by means of a dispersing apparatus such as an ultrasonic dispersing machine, a ball mill, a sand mill, a homo-mixer, and that the resulting dispersion composition is coated. In this case, a binder resin and additives are just added to the dispersion composition.

Various kinds of known solvents and dispersion media can be used in the formation of the photosensitive layer. Specifically mentioned are: butylamine, ethylenediamine, N,N-dimethylformamide, acetone, methyl ethyl ketone, cyclohexanone, tetrahydrofuran, dioxane, ethyl acetate, butyl acetate, methyl cellosolve, ethyl cellosolve, ethylene glycol, dimethyl ether, toluene, xylene, acetophenone, chloroform, dichloromethane, dichloroethane, trichloroethane, methanol, ethanol, propanol, and butanol.

Any known binder resin may be used in the formation of charge generating layer or charge transporting layer, but hydrophobic and film-forming high molecular wight polymers are particularly preferred. Such high molecular weight polymers include the following but are not limited thereto: polycarbonate resins, polycarbonate Z resins, acrylic resins, methacrylic resins, polyvinyl chloride, polyvinylidene chloride, polystyrene, a styrene-butadiene copolymer, polyvinyl acetate, polyvinyl formal, polyvinyl butyral, polyvinyl acetal, polyvinyl carbazole, styrene-alkyd resins, silicone resins, silicone-alkyd resins, polyester resins, phenol resins, polyurethane resins, epoxy resins, a vinylidene chloride-acrylonitrile copolymer, a vinyl chloride-vinyl acetate copolymer, and a vinyl chloride-vinyl acetate-maleic anhydride copolymer.

The ratio of the charge generating material to the above-mentioned binder resin is preferably in the range of 10 to 600% by weight, more preferably in the range of 50 to 400% by weight. The ratio of the charge transporting material to the binder resin is preferably in the range of 10 to 500% by weight. When the photosensitive layer has a laminate structure, the thickness of the charge generating layer is set in the range 0.01 to 20 μm, and particularly preferably in the range of 0.05 to 5 μm. The thickness of the charge transporting layer is set in the range of 1 to 100 μm, and particularly preferably in the range of 5 to 30 μm.

As the conductive substrate can be used, besides a metallic plate and a metallic drum, a plastic film or paper on which a conductive compound such as a conductive polymer or indium oxide, or a foil of metal such as aluminum or palladium is provided by coating, vacuum deposition, or laminating. The thickness of the conductive substrate is set in the range of 0.01 to 5 mm, and particularly preferably in the range of 0.1 to 3 mm.

If desired, an intermediate layer may be laid on the conductive support. Materials for forming the intermediate layer include known compounds such as organometallic compounds including organozirconium compounds, polyvinyl butyral, silane coupling agents, polyvinylpyridine, polyvinylpyrrolidone, phenol resins, polyvinyl alcohol, poly-N-vinylimidazole, polyethylene oxide, ethyl cellulose, methyl cellulose, ethylene-acrylic ester copolymers, casein, polyamide, glue, and gelatin. These are coated, dissolved in a suitable solvent. The thickness of the intermediate layer is usually set in the range of 0.2 to 2 μm.

The photoreceptor of the present invention has a structure as described above and is excellent in charging properties, sensitivity properties, and repeated use properties as is clear form the following examples.

EXAMPLES

The present invention is now illustrated in more detail with reference to examples, but it should not be understood that the present invention is not construed as being limited thereto. All the percents, parts, and ratios are by weight unless otherwise indicated.

Measuring Conditions of X-Ray Diffractometry

In the present invention, X-ray diffraction spectra were obtained in the following conditions. "Peak" refers to a clear sharp-angled projection distinct from the noises. Measurement was carried out by using CuKα characteristic X-ray in the following conditions:

| | |
|---|---|
| Measuring Apparatus: | X-ray Diffractometer manufactured by Rigaku Denki Co. |
| X-ray Tube: | Cu |
| Tube Voltage: | 40 kV |
| Tube Current: | 50 mA |
| Sampling Width: | 0.010° |
| Starting Angle (2θ): | 3° |

-continued

| | |
|---|---|
| End Angle (2θ): | 50° |
| Scanning Speed: | 8.00°/min. |

Preparation of Granular Trigonal Selenium by $H_2O_2$ Reduction

In 200 g of a 50% sodium hydroxide aqueous solution was dissolved 24 g of amorphous selenium. The resulting solution was stirred at 85° C. for 5 hours, and 50 g of deionized water was added thereto, followed by stirring. The resulting solution was allowed to stand for 18 hours and then cooled. The solution was poured into 3000 g of deionized water while being stirred. Then, 20 g of 30% of aqueous hydrogen peroxide was added dropwise at a rate of 2 ml/min while the obtained solution was kept at 48° C.

Figure 7:
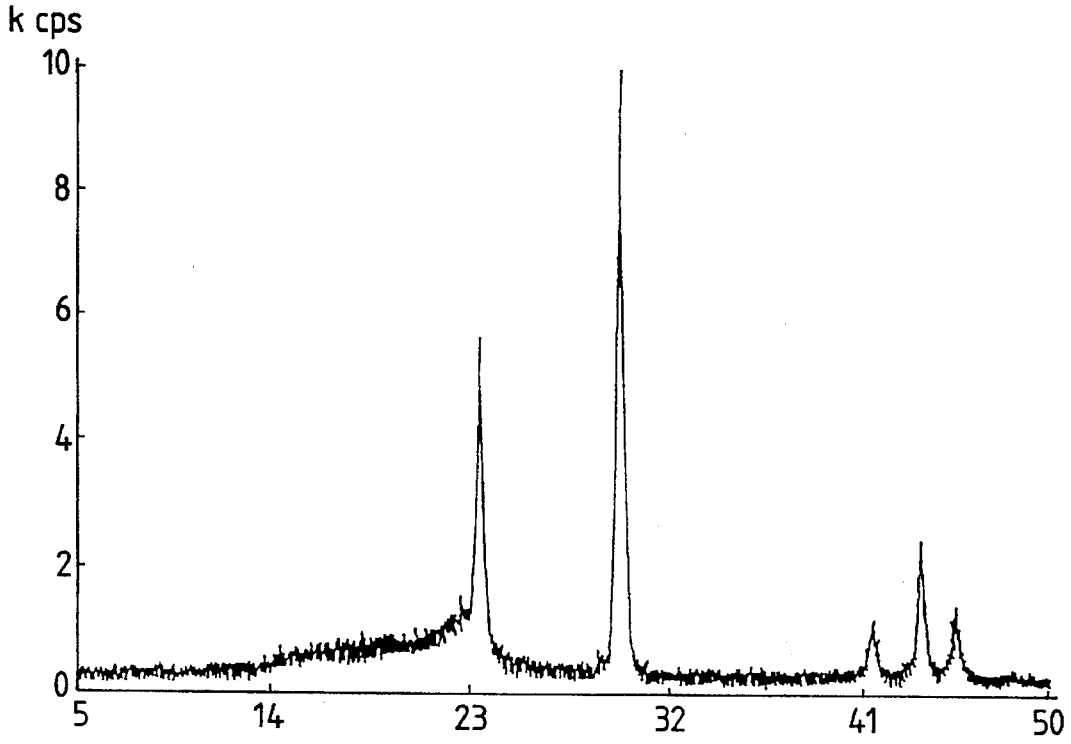
FIG. 7 is an X-ray diffraction pattern of granular trigonal selenium in Example.

After the termination of the addition of hydrogen peroxide, the resulting solution was further stirred for an additional 30 minutes period. During the stirring, trigonal selenium started to precipitate as particles having a mean particle diameter of 2 μm. After complete sedimentation of the trigonal selenium precipitate, the supernatant liquid was removed by decantation. Washing with deionized water followed by decantation was repeated several times. Then, the trigonal selenium precipitate was collected by filtration and dried in an oven at 60° C. for 18 hours. The X-ray diffraction pattern of the resulting trigonal selenium is shown in FIG. 7.

| Preparation of Electrophotographic Photoreceptor | |
|---|---|
| Toluene solution of acetylacetonato-tributoxyziroconium ("ZC 540" produced by Matsumoto Kosho K.K.) (acetylacetonato-tributoxyzirconium/toluene = 1:1 on weight basis) | 100 parts |
| γ-Aminopropyltrimethoxysilane $H_2NC_3H_6Si(OCH_3)_3$ ("A1110" produced by Nippon Unicar Co., Ltd.) | 11 parts |
| Ethyl alcohol | 600 parts |
| n-Butyl alcohol | 150 parts |

The above components were stirred in a stirrer to prepare a coating composition for a subbing layer. This coating composition was coated on an aluminum pipe by dip coating and dried by heating at 100° C. for 5 minutes to form a 0.2 μm thick subbing layer.

Next, in 200 parts of n-butyl acetate were dissolved 87 parts of granular trigonal selenium obtained in the above-described manner and 13 parts of a vinyl chloride-vinyl acetate copolymer (commercial name "Solution Vinyl VMCH" produced by Union Carbide Co.). The resulting solution was subjected to dispersion treatment by means of an attritor for 24 hours. A 30 parts aliquot of the resulting dispersion was diluted with 57 parts of n-butyl acetate to prepare a dip coating composition.

Into a dip coating bath containing this dip coating composition was immersed the aluminum pipe comprising the subbing layer, which was then taken up at a speed of 100 mm/min and dried by heating at 100° C. for 5 minutes to laminate the subbing layer of the aluminum pipe with a charge generating layer having a thickness of about 0.1 μm.

Then, in 80 parts of monochlorobenzene were dissolved 10 parts of N,N'-diphenyl-N,N'-bis(3-methyl-phenyl)-[ 1,1'-biphenyl]-4,4'-diamine and 10 parts of a polycarbonate Z resin to prepare a coating composition for a charge transporting layer. This coating composition was coated on the above-described charge generating layer and dried in hot air at 100° C. for 60 minutes to form a 25 μm thick charge transporting layer.

The thus produced electrophotographic photoreceptor was mounted on a copying machine ("VIVACE 500" manufactured by Fuji Xerox Co., Ltd.). After the system was adjusted so as to give a dark potential $V_D$ of −800 V, the photoreceptor was exposed to light of 2 erg/cm$^2$, and the highlight potential $V_L$ was measured. Thereafter, a durability test of obtaining 100,000 copies was conducted, and changes in $V_D$ and $V_L$ were measured. The results obtained are shown in Table 1 given below.

COMPARATIVE EXAMPLE

Figure 8:
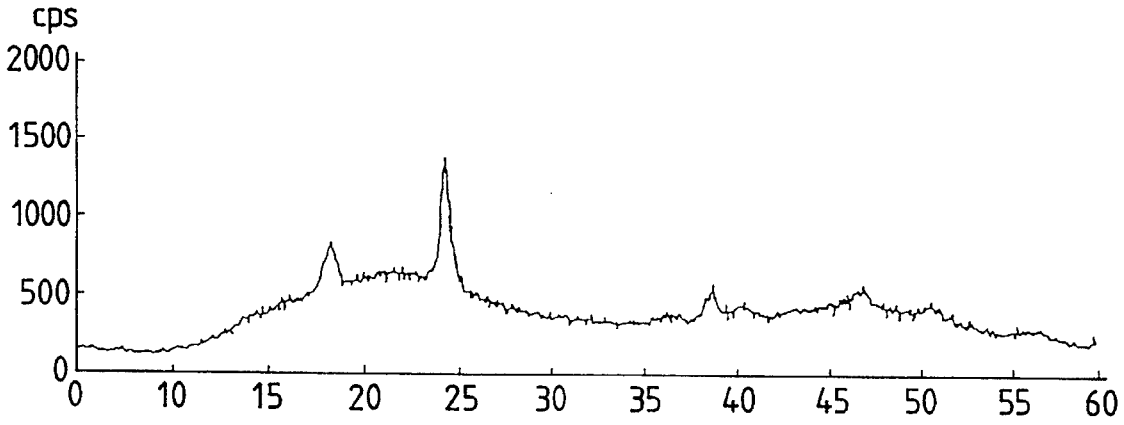
FIG. 8 is an X-ray diffraction pattern of granular trigonal selenium in Comparative Example.

Prepared was 500 ml of a 3% selenium oxide ($SeO_2$) aqueous solution, which was maintained at 60° C. While this solution was being stirred, sulfurous acid was introduced thereinto at a rate of 90 ml/min to bubble for 5 minutes in order to reduce selenium oxide. After the completion of bubbling, the solution was further stirred for 30 minutes. Meanwhile, trigonal selenium was crystallized and began to precipitate as particles having a mean particle diameter of 7 μm. Washing and drying the trigonal selenium precipitate was effected in the same manner as in Example. The X-ray diffraction pattern of the resulting trigonal selenium is shown in FIG. 8.

Then, by using the above-described trigonal selenium, an electrophotographic photoreceptor was produced, which was used for evaluation. That is, an electrophotographic photoreceptor was prepared in the same manner as in Example except that the above-described trigonal selenium was used in place of the granular trigonal selenium in Example. Evaluation was also carried out in the same manner. The results are shown in Table 1.

TABLE 1

| | Electrophotographic Characteristics (−Volts) | | |
|---|---|---|---|
| | Initial | After durability Test | |
| | $V_L$ | $V_D$ | $V_L$ |
| Example | 100 | 805 | 150 |
| Comparative Example | 130 | 610 | 210 |

The electrophotographic photoreceptor according to the present invention, prepared by using the above-described granular trigonal selenium as charge generating material, has high photosensitivity and low residual potential, maintains its potential characteristics in a stable manner on repeated use, and exhibits sufficient photosensitivity even when applied to high-speed copying.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a photosensitive layer containing granular trigonal selenium which has a mean particle diameter of 0.01 μm to not more than 5 μm and which has absorption peaks in the X-ray diffraction spectrum using CuKα characteristic X-rays at Bragg angles (20°±0.2°) of 23.5°, 29.7°, 41.4° and 45.4° produced by the method comprising the reductive deposition of selenium with aqueous hydrogen peroxide by controlling the molar ratio of $Se/H_2O_2$ in the range of 1.5 to 2.0, controlling the addition rate of said aqueous hydrogen peroxide; and controlling the solution temperature in the range of 35°–60° C.

2. An electrophotographic photoreceptor as in claim 1, wherein the absorption peaks at Bragg angles (20°±0.2°) of 23.5° and 29.7° are the main peaks, the absorption intensity at 29.7° being the strongest.

3. A method of preparing granular trigonal selenium having a mean particle diameter of 0.01 μm to not more than 5 μm and which has absorption peaks in the X-ray diffraction spectrum using CuKα characteristic X-rays at Bragg angles (20°±0.2°) of 23.5°, 29.7°, 41.4° and 45.4° comprising the reductive deposition of selenium with aqueous hydrogen peroxide by controlling the molar ratio of $Se/H_2O_2$ in the range of 1.5 to 2.0, controlling the addition rate of said aqueous hydrogen peroxide; and controlling the solution temperature in the range of 35°–60° C.

4. The method as in claim 3, wherein the absorption peaks at Bragg angles (20°±0.2°) of 23.5° and 29.7° are the main peaks, the absorption intensity at 29.7° being the strongest.

* * * * *